US008887318B2

(12) United States Patent
Mazzarolo et al.

(10) Patent No.: US 8,887,318 B2
(45) Date of Patent: Nov. 18, 2014

(54) IMPACT ABSORBING LINER WITH ADJUSTMENT DEVICE

(75) Inventors: Giovanni Mazzarolo, Coste di Maser (IT); David Rogers, Boston, MA (US); Edward Hall, Somerville, MA (US); Duco Noordzij, Roxbury, MA (US)

(73) Assignee: Alpinestars Research SRL, Coste di Maser (Treviso) (IT)

( * ) Notice: Subject to any disclaimer, the term of this patent is extended or adjusted under 35 U.S.C. 154(b) by 239 days.

(21) Appl. No.: 13/266,014

(22) PCT Filed: Apr. 24, 2009

(86) PCT No.: PCT/IT2009/000186

§ 371 (c)(1),
(2), (4) Date: Jan. 17, 2012

(87) PCT Pub. No.: WO2010/122586

PCT Pub. Date: Oct. 28, 2010

(65) Prior Publication Data

US 2012/0110720 A1 May 10, 2012

(51) Int. Cl.
*A42B 1/22* (2006.01)
*A42B 3/32* (2006.01)

(52) U.S. Cl.
CPC ..... *A42B 3/324* (2013.01)
USPC ..... 2/417; 2/411; 2/414

(58) Field of Classification Search
USPC ..... 2/411, 414, 416–421
See application file for complete search history.

(56) References Cited

U.S. PATENT DOCUMENTS

| | | | | |
|---|---|---|---|---|
| 3,720,955 | A * | 3/1973 | Rawlings | 2/415 |
| 4,024,586 | A * | 5/1977 | Lamb | 2/414 |
| 4,239,106 | A | 12/1980 | Aileo | |
| 5,765,234 | A | 6/1998 | Petzl et al. | |
| 5,774,901 | A * | 7/1998 | Minami | 2/421 |
| 5,815,847 | A * | 10/1998 | Holden, Jr. | 2/418 |
| 5,829,065 | A * | 11/1998 | Cahill | 2/418 |
| 5,950,244 | A * | 9/1999 | Fournier et al. | 2/414 |
| 6,314,587 | B1 * | 11/2001 | Fang | 2/418 |
| 7,159,249 | B2 * | 1/2007 | Dennis et al. | 2/421 |
| 7,950,073 | B2 * | 5/2011 | Ferrara | 2/417 |
| 2006/0096011 | A1 * | 5/2006 | Dennis et al. | 2/414 |
| 2006/0225187 | A1 | 10/2006 | Wu | |
| 2007/0266481 | A1 | 11/2007 | Alexander et al. | |
| 2008/0060117 | A1 * | 3/2008 | Timms | 2/171 |
| 2009/0031482 | A1 * | 2/2009 | Stokes et al. | 2/414 |
| 2009/0038055 | A1 * | 2/2009 | Ferrara | 2/421 |

(Continued)

FOREIGN PATENT DOCUMENTS

| | | |
|---|---|---|
| DE | 102 18 269 | 11/2003 |
| FR | 2 539 010 | 7/1984 |

OTHER PUBLICATIONS

International Search Report, dated Jan. 29, 2010, from International Application No. PCT/IT2009/000186.

(Continued)

*Primary Examiner* — Khoa Huynh
*Assistant Examiner* — Andrew W Collins
(74) *Attorney, Agent, or Firm* — Katten Muchin Rosenman LLP

(57) ABSTRACT

An impact absorbing liner for use as part of a helmet that comprises adjustable means which allow to change the interior size and shape of the liner. The impact absorbing liner can be adjusted by operating on an actuation mechanism.

18 Claims, 10 Drawing Sheets

(56) References Cited

U.S. PATENT DOCUMENTS

| | | | | |
|---|---|---|---|---|
| 2009/0320185 | A1* | 12/2009 | Hassler | 2/414 |
| 2009/0320187 | A1* | 12/2009 | Petzl et al. | 2/417 |
| 2010/0186150 | A1* | 7/2010 | Ferrara et al. | 2/412 |
| 2011/0214223 | A1* | 9/2011 | Rogers et al. | 2/418 |
| 2013/0000015 | A1* | 1/2013 | Marzec et al. | 2/411 |
| 2013/0125294 | A1* | 5/2013 | Ferrara | 2/411 |

OTHER PUBLICATIONS

International Preliminary Report on Patentability, dated Aug. 29, 2011, from International Application No. PCT/IT2009/000186.

* cited by examiner

IMPACT ABSORBING LINER WITH ADJUSTMENT DEVICE

This invention relates to an impact absorbing liner for use as part of a helmet, provided with an adjustment device.

Various protective helmets are known and are commercially available.

Many protective helmets, especially those used during sporting activities, utilize a construction based on three primary components. The first component is a rigid exterior shell which protects the user against crushing hazards, sharp objects penetration and abrasion. Made of fiber-reinforced composites or thermoplastics, like polycarbonate, this shell is also able, in the event of an accident, to dissipate the impact energy by spreading the impact forces into a second primary component.

This second primary component is an impact absorbing liner situated adjacent to the exterior helmet shell. It has an interior shape corresponding to the user's head and is designed to absorb forces resulting from impact thereby reducing the amount of force passed on to the head.

In order to absorb higher impact forces, the materials used for this second component are relatively rigid, like expanded polystyrene, and thereby not soft or compressible enough to adapt to different head shapes or sizes.

Therefore, to fit a helmet to the shape and size of different heads, common practice is to use a third component, a comfort liner. This comfort liner resides on the interior of the impact liner adjacent to the head and is usually made of a combination of soft foam and fabric materials which can flex and compress under a small amount of pressure. In this way, the comfort liner can change its shape and thereby conforms to that of the head inside the helmet.

The greater the deviation between the shape of a user's head and the shape of the rigid impact liner interior, the worse a comfort liner and subsequent helmet performs. This is because in order for the comfort liner to be considered comfortable it must also be soft and compliant. In order for a helmet to be considered stable, the connection between the head and the impact liner must be rigid and secure. This creates a contradictory requirement inherent to the comfort liner system in that it needs to be soft and conformal and yet also rigid and secure. Therefore, it is difficult for helmets comprising of these three primary components to be comfortable and stable unless the rigid impact liner is very close in shape and size to that of the user's head. In this way, the comfort liner can be soft and conformal while having the support and stability of the rigid impact liner right beside it.

To achieve this result, most helmet manufacturers try and offer a variety of helmet shapes and/or sizes to help customers find one that most closely matches that of their own head. This approach works reasonably well, but it is often difficult and expensive for manufacturers to make enough helmet shapes and sizes to adequately fit all of the population. In reality, some people find helmets that fit them great, some people find helmets that fit them ok, and some people cannot ever find a helmet that is comfortable and also stabile/secure.

The comfort/fitting/security issue is a common challenge to all helmets that use rigid exterior materials in their construction. Because of this, different methods for affecting the interior shape of the helmet liner have been developed. By allowing the interior shape of a helmet liner to change and adjust to that of the head of a wearer, less demand is placed on the comfort liner materials to provide support and stability. This in turns allows them to be softer and more compliant and hence more comfortable.

Hockey helmets achieve this shape changing ability by making the rigid components of the helmets in two or more pieces that are allowed to move relative to one another. The user can move said pieces, usually the front and the back halves of the helmet, toward or away from each other to change the interior shape and size of the liner.

This liner adjustment system is suitable for this kind of helmet but it can not provide adequate energy impact dissipation or structural integrity to protect against hazards found in motorsport.

Bicycle helmets and hard-hats often utilize a fourth component that resides inside of the impact liner to assist and sometimes replace the function of the comfort liner component. These helmets utilize a flexible circumferal adjustment strap attached to a turn-dial knob or ratchet mechanism that is able to tighten the strap when it is rotated. By tightening the strap, the circumference of the strap decreases and it changes its shape in order to match with the user's head. However, because the tightening of the strap is not dependent on the compression of an arbitrary amount of foam like that of traditional comfort liners, it does not create greater or lesser pressure points. This results in an improved helmet liner that is not considered to be too tight in some locations and too loose in others.

While liner adjustment technology that uses a circumferal adjustment strap can offer improvements in helmet fit and comfort over traditional comfort liner foam solutions, it is not stable or secure enough to support helmets that weigh more than approximately 600 grams. This is why they are most commonly used in bicycle, ski/snowboard, and hard-hat style helmets. Unfortunately, the heavier a helmet becomes, the worse the performance of a traditional strap based system becomes.

The added protection required for helmets used in motorsports related activities typically results in helmets weighing greater than 600 grams. Because of this, circumferential strap adjustment technology has never been adopted for this type of helmet.

The object of the invention is to provide an helmet which solves the above mentioned problems and drawbacks.

In particular, the object of the present invention is to provide an helmet which can be easily adapted to the size and shape of the user's head.

These and other objects are achieved by the impact absorbing liner according to claim 1.

The advantages and the characteristic features of the invention will emerge more clearly from the following description of a preferred, but not exclusive, embodiment of the impact absorbing liner which refers to the accompanying figures in which.

In the following description of the impact absorbing liner of the invention, as internal there will be indicated the part or component of the impact absorbing liner relatively closer to the user's head and as external the part or component relatively farther.

Similarly, as front there will be indicated the part or component of the impact absorbing liner relatively closer to the user's face and as rear the part or component relatively closer to the occipital bone of the user.

Figure 1:
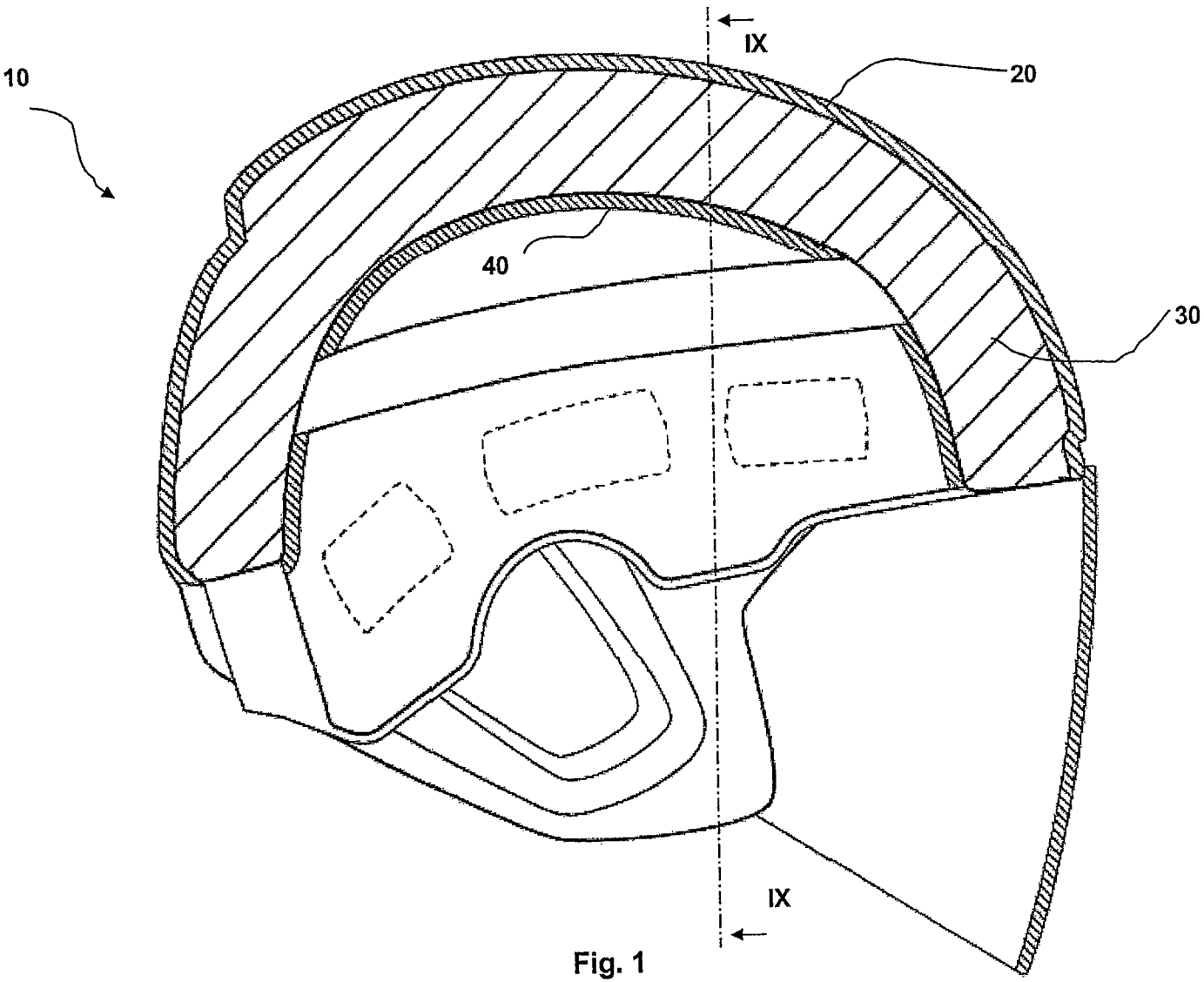
FIG. 1 shows a cross sectional view of an helmet according to the invention.
Figure 2:
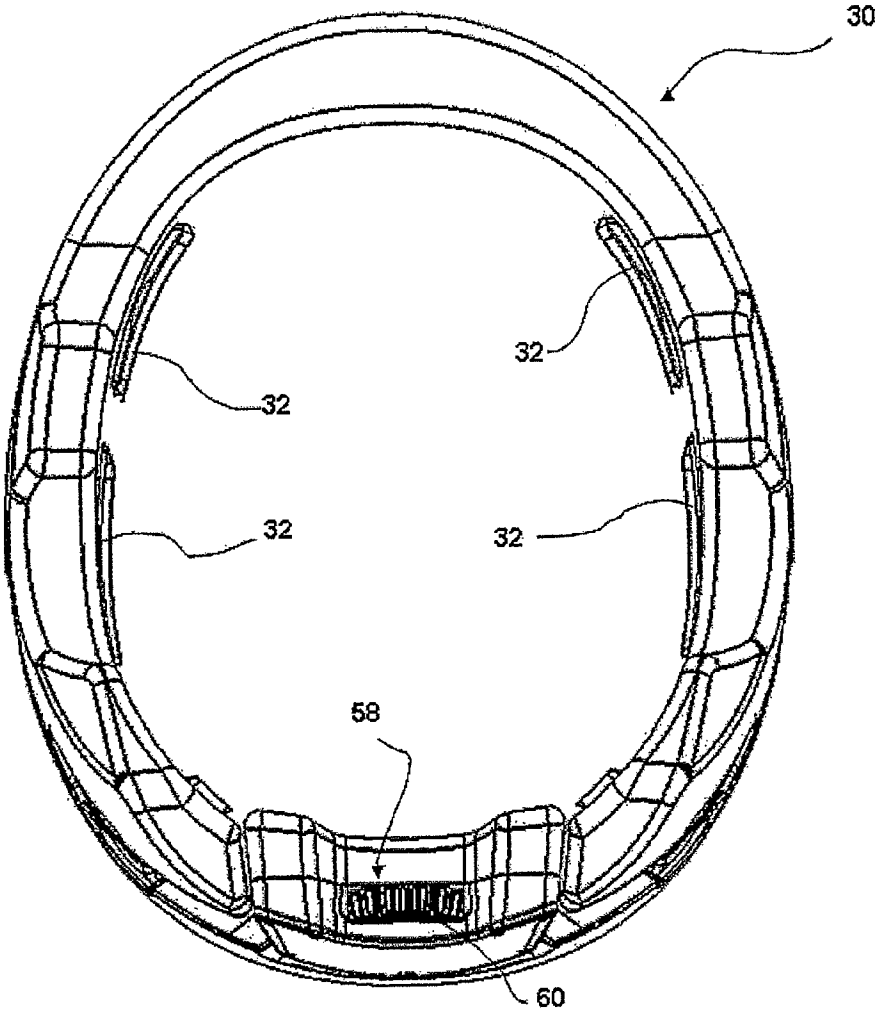
FIG. 2 shows a bottom view of an helmet liner according to the invention.

With reference first of all to FIGS. 1 and 2, the helmet 10 comprises an external shell 20, an impact absorbing liner 30 and a comfort liner 40.

The impact absorbing liner 30 comprises adjustable means 32 which allow for the size and shape adjustment inside of the helmet to the user's head.

According to a preferred embodiment, the adjustable means 32 may consist of a plurality of blocks 32 having a generally rectangular shape or however these blocks 32 could be envisaged to be of any shape as the design commands.

These adjustable means 32 are made of impact absorbing materials including but not limited to expanded polystyrene and expanded polypropylene.

Figure 6:
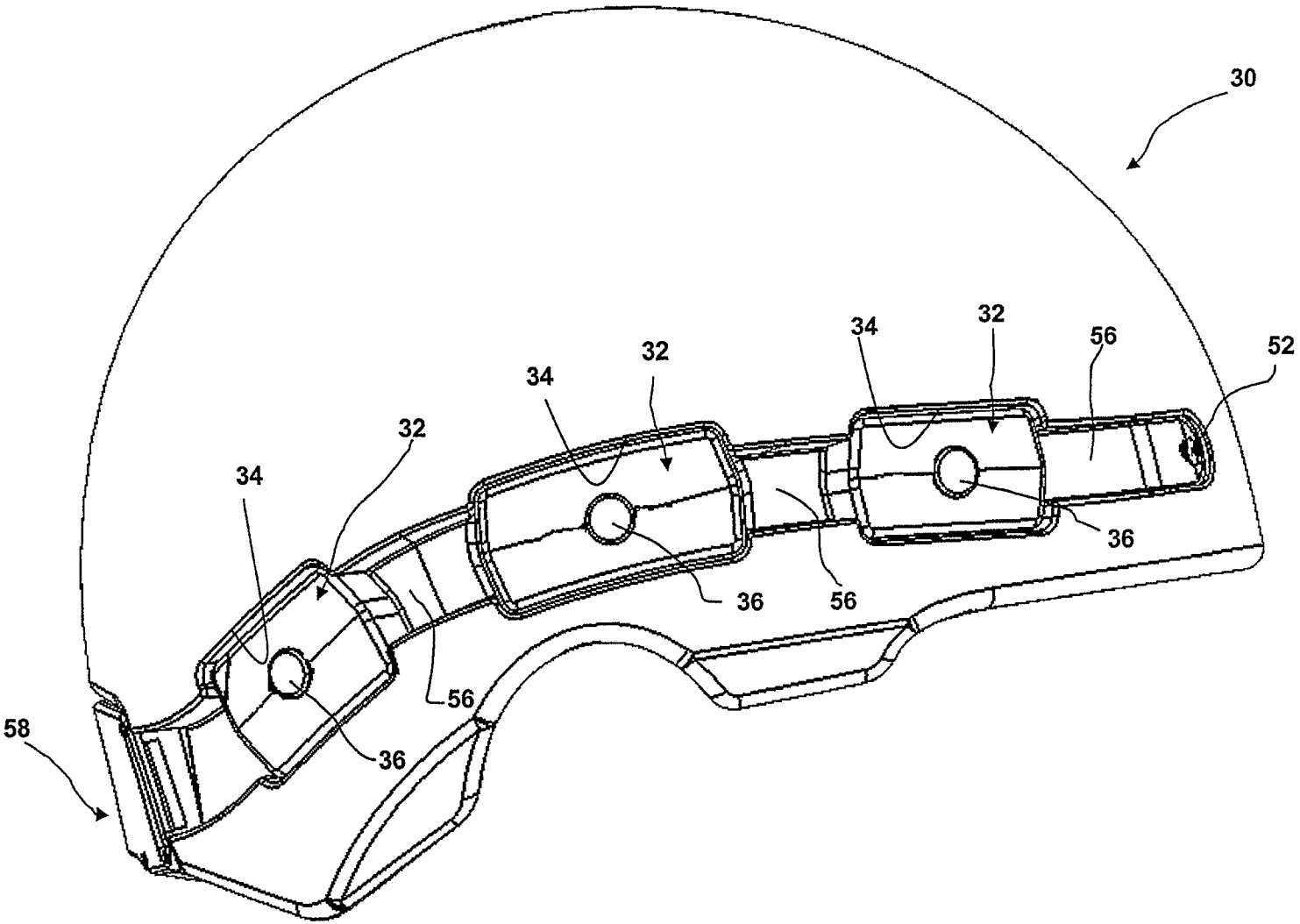
FIG. 6 shows a side view of the helmet liner according to the invention.
Figure 7:
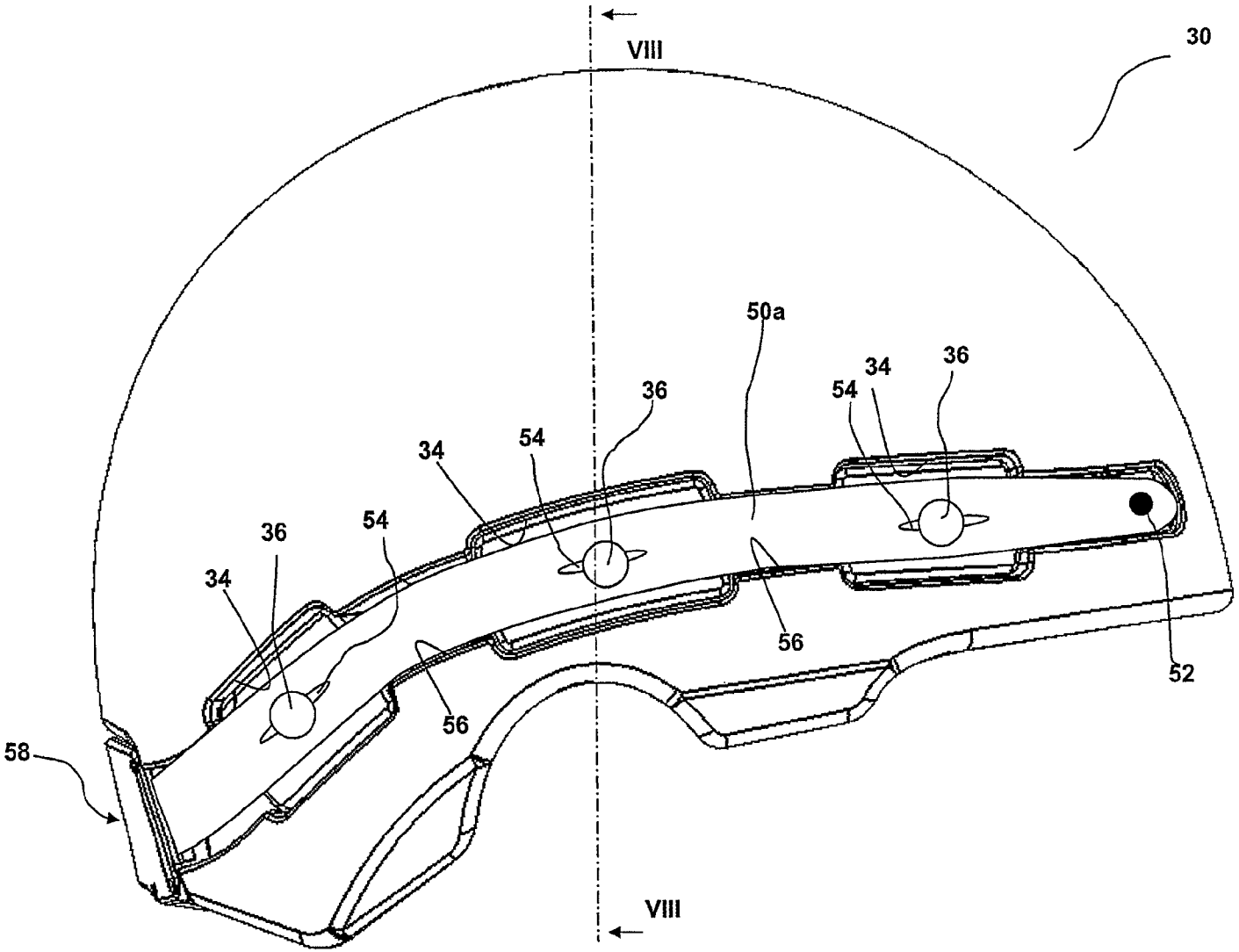
FIG. 7 shows a view like FIG. 6 with the adjusting strap.

In a preferred embodiment as shown in FIG. 6, the impact absorbing liner 30 is provided with six blocks 32, three blocks for each side with respect to the central vertical symmetry plane of the helmet.

These blocks 32 are arranged in locations starting at the temple area, over the ears, and around the area of the occipital bone, thereby surrounding the perimeter of the head with the exception of the forehead.

The inside of each block 32 lies adjacent to comfort liner 40.

Figure 3:
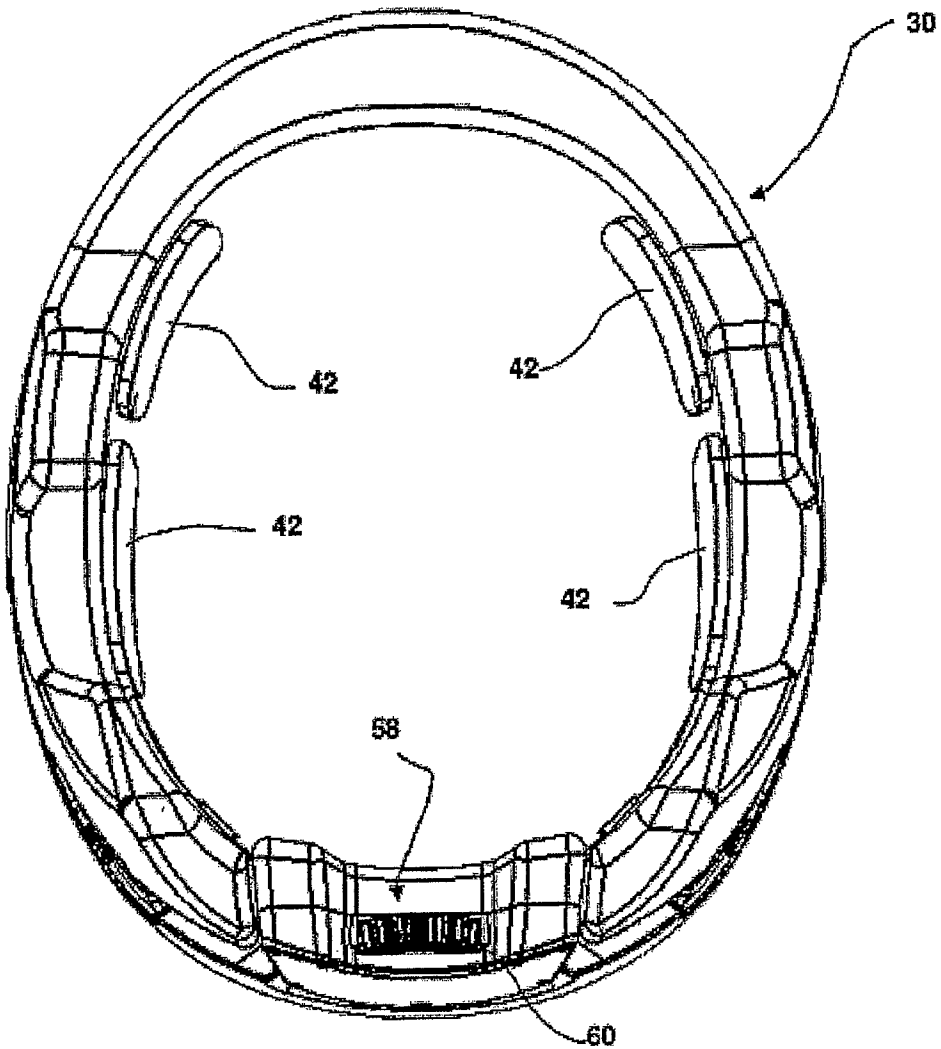
FIG. 3 shows a view like FIG. 2 with padding means.
Figure 5:
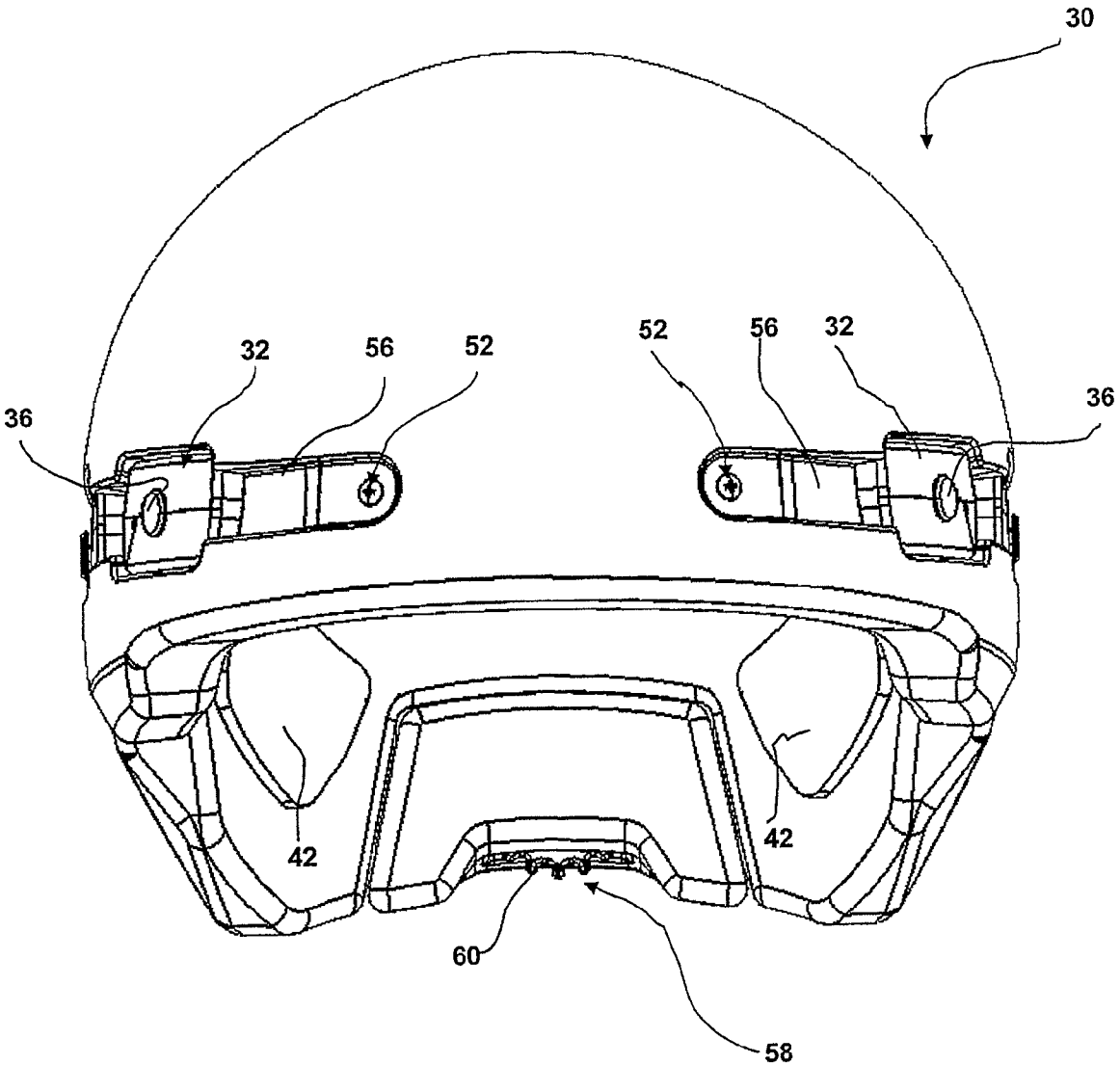
FIG. 5 shows a view like FIG. 4 with padding means.

In a preferred embodiment, as shown in FIGS. 3 and 5, on the internal side of each block 32 a pad 42 is attached with means suitable to fix it in a known manner. Said pad 42 lies between the block 32 and the comfort liner 40.

Each block 32 has, mounted on its external face, a coupling pin 36 consisting of a central body ending with a widened extension.

Figure 8:
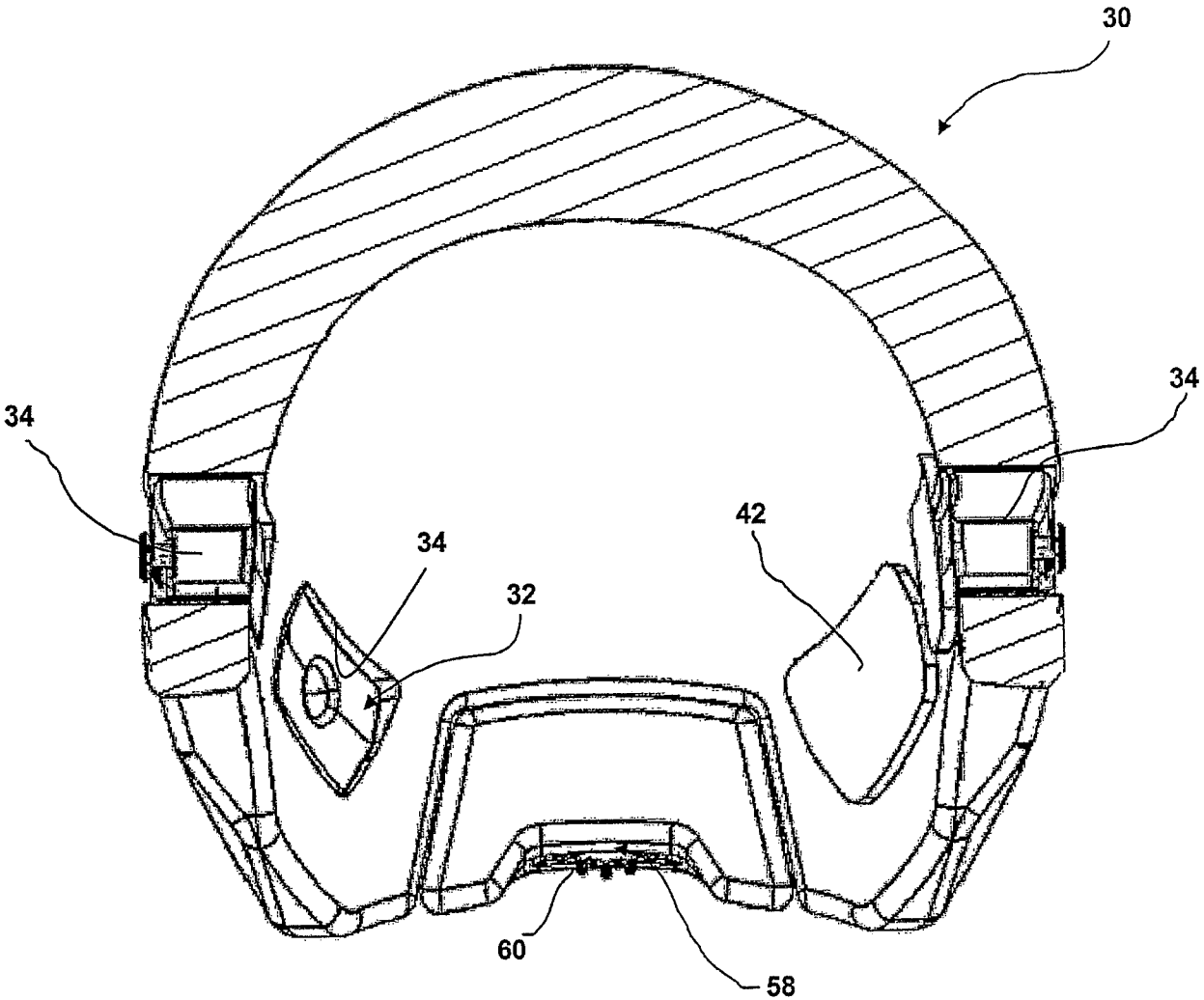
FIG. 8 shows a cross-sectional view of the helmet liner along the plane VIII-VIII of FIG. 7.
Figure 9:
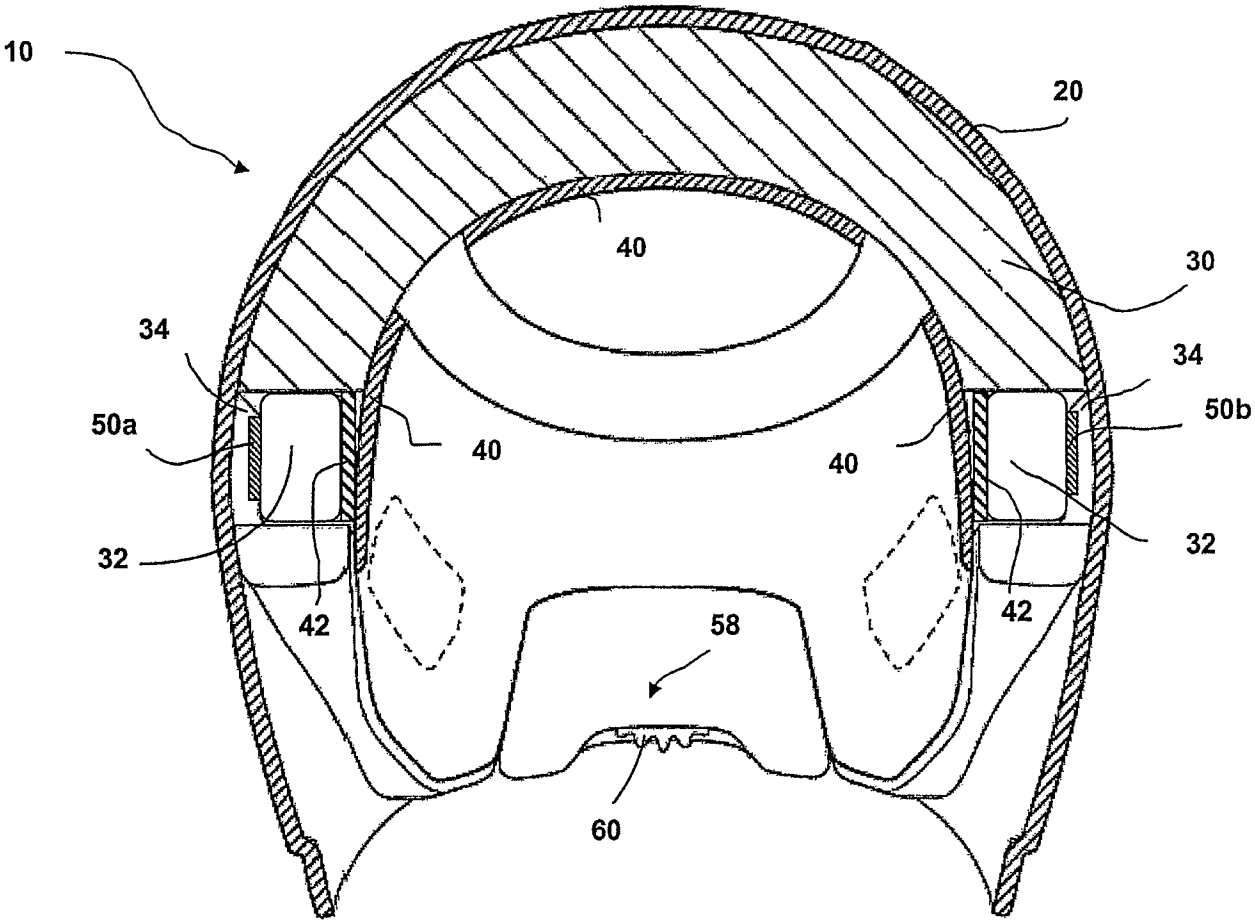
FIG. 9 shows a schematic cross-sectional view of the helmet along the plane IX-IX of FIG. 1.

The blocks 32 are housed into correspondingly shaped through cavities 34 provided in the impact absorbing liner 30. These cavities 34 connect the internal side and the external side of the impact absorbing liner 30 and are shaped, as shown in FIG. 8, so as to prevent any side displacement of the blocks 32, except for the movement towards or away from the user's head. With reference to the FIGS. 10 and 11, the blocks 32 can move only in the direction marked by the arrows F.

On each external side of impact absorbing liner 30, a flexible strap 50*a*, 50*b* is mounted. Said strap 50*a*, 50*b* is permanently fixed to front of liner 30 by means of hardware 52 which does not affect the impact absorption characteristics of impact absorbing liner 30, and it is housed into a groove 56 which provides a slide guide for the strap 50*a*, 50*b*. The groove 56, in fact, prevents the strap 50*a*, 50*b* from being blocked between the impact liner 30 and the external shell 20. The strap 50*a*, 50*b* is also laterally constrained by this groove 56 so that it cannot move up or down with respect to the horizontal plane of the impact absorbing liner.

The strap 50*a*, 50*b* is attached to the blocks 32 by means of key slots 54 which engage the coupling pins 36. Said key slots 54 allow the strap 50*a*, 50*b* to slide front to back while the blocks 32 and the strap 50*a*, 50*b* are adjoined side-to-side.

Figure 4:
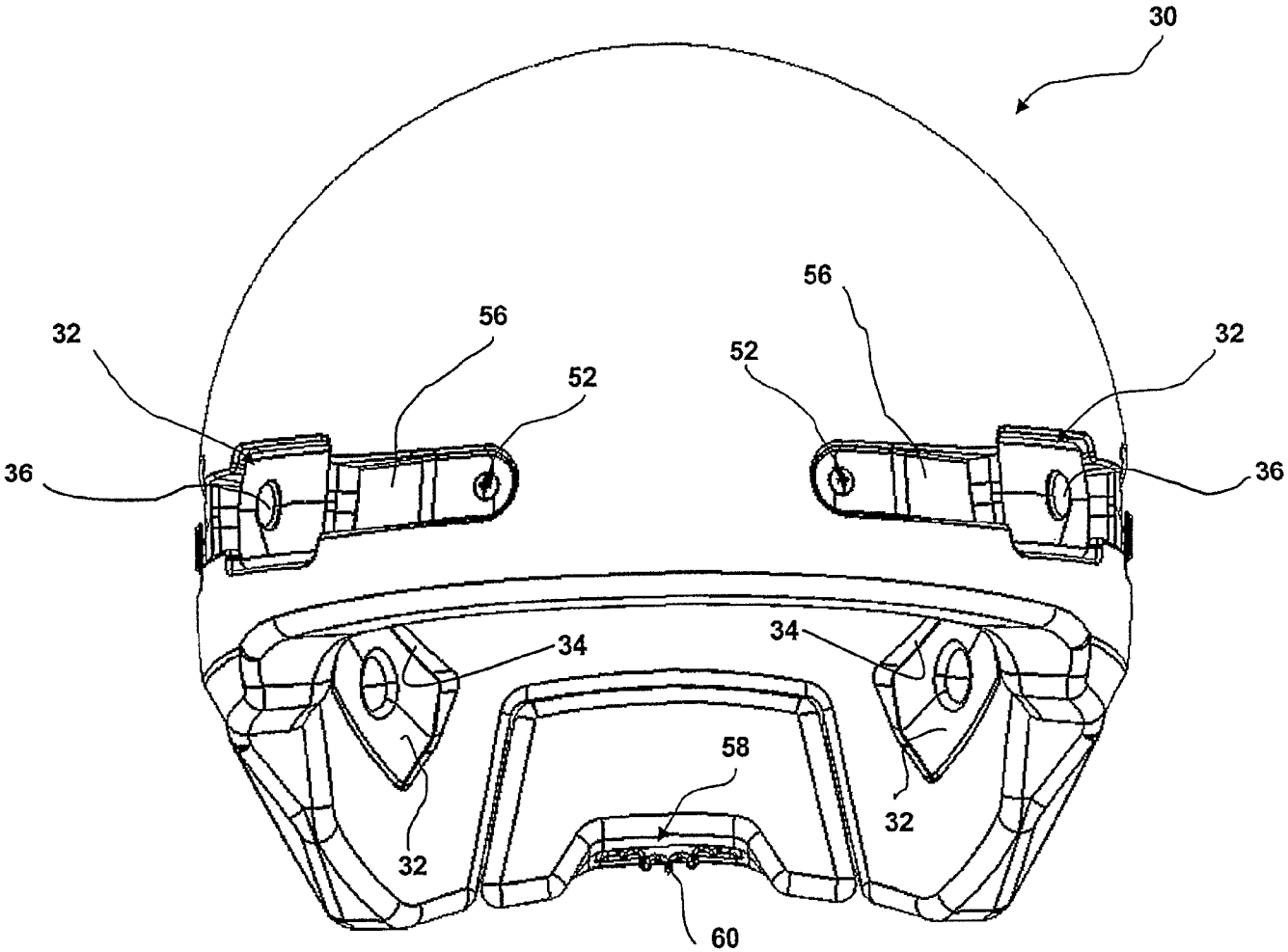
FIG. 4 shows a front view of the helmet liner according to the invention.

The strap 50*a*, 50*b* is also connected to an actuation mechanism 58 positioned on the rear part of the impact absorbing liner 30. According to a preferred embodiment shows in FIGS. 4 and 5, said actuation mechanism 58 consists of a ratchet mechanism comprising a knob 60. By rotating of the knob 60, the length of the strap 50*a*, 50*b* can be changed.

Usually, when the knob 60 is rotated in a clockwise direction, the straps 50*a*, 50*b* will be pulled together towards the rear part of the helmet, thereby decreasing the overall circumference of the straps 50*a*, 50*b*, whereas, if the knob 60 is rotated in a counter clockwise direction, the straps 50*a*, 50*b* will be loosened thereby increasing the overall circumference of the straps 50*a*, 50*b*.

In another embodiment (not shown) the actuation mechanism 58 consist of a sliding locking lever that is suitable to increase or decrease the circumference of the straps 50*a*, 50*b* in a known manner.

It should be noted that the ratchet mechanism and the sliding locking lever are self locking devices so as to prevent the changing of the strap 50*a*, 50*b* length without deliberate user input to the actuation mechanism 58.

For example, the knob 60 can be locked to prevent any user input from increasing or decreasing of the overall circumference of the straps 50*a*, 50*b*.

Hereafter the operation of the adjustment device of the impact absorbing liner 30 will be described.

When the user wears the helmet 10, he has to check that the helmet 10 is stable and secured on his head. In fact, as before mentioned, also if the size of the helmet 10 fits quite properly on the user's head, the helmet 10 could be still slightly tight or large.

If the user, for example, feels that there is a gap between his temples and the pads 42, he can adjust the impact absorbing liner 30 by operating on the knob 60.

Figure 11:
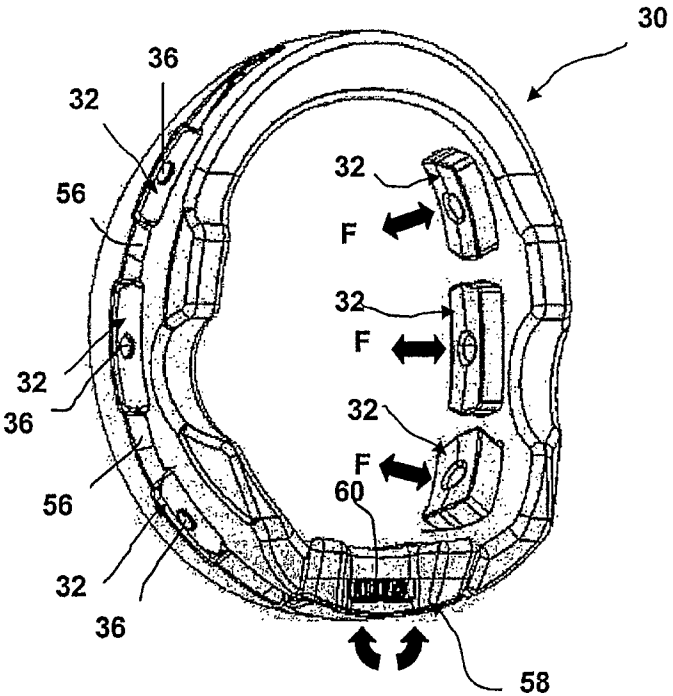
FIG. 11 shows a perspective bottom view of FIG. 10 with the adjustment block in forward position.
Figure 10:
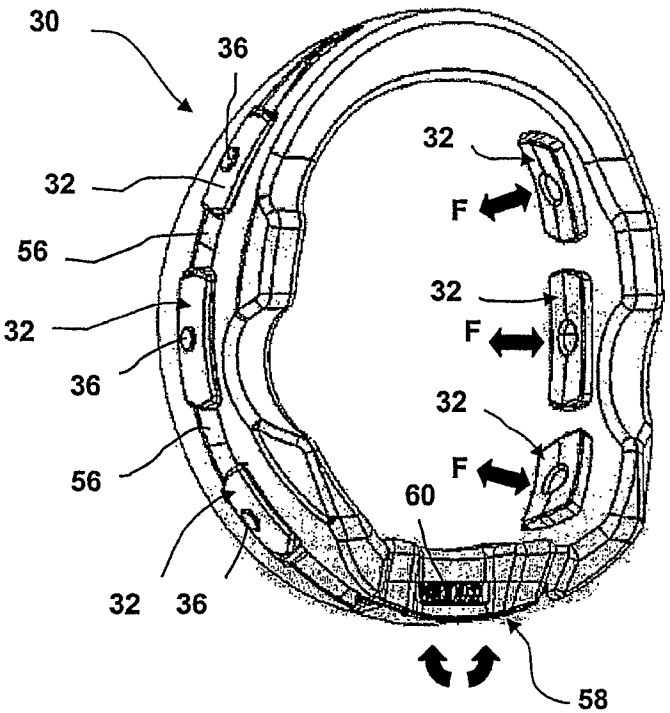
FIG. 10 shows a perspective bottom view of the helmet liner.

With a simple hand movement, the user can rotate in a clockwise direction the knob 60 and, in this way, the user can decrease the overall circumference of the straps 50*a*, 50*b*. As the straps 50*a*, 50*b* are connected to the blocks 32 by means of the pins 36 which engage the key slots 54, when the length of straps 50*a*, 50*b* decreases, the blocks 32 are forced to move toward the user's head, as shown in FIGS. 10 and 11.

As a consequence of the movement of the blocks 32 toward the user's head, the size of the inside of the helmet liner 30 is modified eliminating the gap between the user's head and the comfort liner 40.

Since the blocks 32 are held against the user's head by the flexible strap 50*a*, 50*b*, a different pressure can be exerted by each block 32 on the user's head thereby creating the right fit to the user's head without any localized pressure point, which may cause a heavy discomfort or even headache after a long ride. In this way, in addition to the size, the shape of the helmet liner 30 is changed, and as consequence the helmet 10 can be worn in a comfortable manner.

At the same time the helmet 10 is stable and secured on the user's head: it will not move around or up and down on the user's head and in particular in case of accident it will be able to absorb the impact forces.

On the contrary, if the user feels the helmet 10 a bit too tight on his head, he can adjust it following a similar procedure.

By rotating the knob in a counter clockwise direction, the length of the straps 50*a*, 50*b* increases. As consequence each block 32 is able to slightly move back, in order to increase the size of the helmet liner. As before mentioned, each block 32 is independent of other blocks 32 and this also allows to modify the shape of the helmet liner in order to make the helmet more comfortable.

When the user feels that the helmet 10 is worn in a comfortable manner, he can lock the knob 60 of the ratchet mechanism to prevent any accidental input from increasing or decreasing of the circumference of the strap. In this way, it's guaranteed that the helmet remains stable and secured on the user's head after the first adjustment.

It should be noted that the adjustment device of the present invention does not affect the outer shell 20 and the comfort liner component 40 of the helmet 10. It is therefore applicable to a variety of safety helmet applications, and could also be adopted by existing helmets without needing any shell or comfort liner adaptation.

From the above description it is clear that the impact absorbing liner object of the present invention has characteristics such as to solve advantageously the problems and drawbacks of the devices set out in the prior art.

The present invention has been described with reference to a preferred embodiment, but mechanically equivalent solutions are foreseeable falling within the scope of the following claims.

The invention claimed is:

1. An impact absorbing liner for use as part of a helmet, the liner comprising:

an adjustable means for adjusting the interior size and shape of the impact absorbing liner, said adjustable means comprising a plurality of blocks, each block being suitable to be displaceable toward or away from the head of the user independently of other blocks, blocks by means of control means and an actuation mechanism;

said control means comprise a flexible strap mounted on each external side of the impact absorbing liner, said flexible straps being permanently fixed to the front of the impact absorbing liner by means of hardware;

wherein each block is housed into a correspondingly shaped through-cavity provided in the impact absorbing liner;

wherein said through-cavity is shaped to prevent any side displacement of the blocks except for the movement towards or away from a head of the user.

2. An impact absorbing liner according to claim 1, wherein said blocks have a generally rectangular shape.

3. An impact absorbing liner according to claim 1, wherein the blocks are arranged in locations starting at temple area, over the ears and around the area of the occipital bone.

4. An impact absorbing liner according to claim 1, wherein said flexible strap is housed into a groove; said groove laterally constraining the strap so that it cannot move up or down with respect to the horizontal plane of the impact absorbing liner.

5. An impact absorbing liner according to claim 1, wherein said flexible strap is connected to the actuation mechanism positioned on the rear part of the impact absorbing liner.

6. An impact absorbing liner according to claim 1, wherein the overall circumference of the flexible straps can be increased or decreased by acting on the actuation mechanism.

7. An impact absorbing liner according to claim 5, wherein said actuation mechanism comprises a ratchet mechanism having a knob.

8. An impact absorbing liner according to claim 1, wherein the actuation mechanism comprises a self-locking device to prevent a changing of a strap length without deliberate user input to the actuation mechanism.

9. An impact absorbing liner according to claim 1, wherein the actuation mechanism can be locked to prevent any user input from increasing or decreasing of the circumference of the straps.

10. An impact absorbing liner according to claim 1, wherein the plurality of blocks comprises an expanded polystyrene or an expanded polypropylene.

11. The impact absorbing liner according to claim 1, wherein the blocks are made of impact absorbing material.

12. An impact absorbing liner for use as part of a helmet, the liner comprising:

an adjustable means for adjusting the interior size and shape of the impact absorbing liner, said adjustable means comprising a plurality of blocks, each block being suitable to be displaceable toward or away from the head of the user independently of other blocks, blocks by means of control means and an actuation mechanism;

said control means comprise a flexible strap mounted on each external side of the impact absorbing liner, said flexible straps being permanently fixed to the front of the impact absorbing liner by means of hardware;

wherein each block has mounted on an external face of the block a coupling pin consisting of a central body ending with a widened extension.

13. An impact absorbing liner for use as part of a helmet, the liner comprising:

an adjustable means for adjusting the interior size and shape of the impact absorbing liner, said adjustable means comprising a plurality of blocks, each block being suitable to be displaceable toward or away from the head of the user independently of other blocks by means of control means and an actuation mechanism, the blocks being made of impact absorbing material;

said control means comprise a flexible strap mounted on each external side of the impact absorbing liner, said flexible straps being permanently fixed to the front of the impact absorbing liner by means of hardware;

wherein said flexible strap is slidably attached to each said block by means of a respective key slot, each key slot engaging a coupling pin and allowing the flexible strap to slide front to back while the blocks and the strap are adjoined side-to-side.

14. An impact absorbing liner according to claim 13, wherein said control means consist of a flexible strap permanently fixed on each side of the impact absorbing liner to the front thereof by means of hardware.

15. An impact absorbing liner according to claim 13, where the coupling pin is mounted on an external face of the respective block.

16. A helmet comprising:

an impact absorbing liner, the liner comprising:

an adjustable means for adjusting the interior size and shape of the impact absorbing liner, said adjustable means comprising a plurality of blocks, each block being suitable to be displaceable toward or away from the head of the user independently of other blocks, by means of control means and an actuation mechanism, the blocks being made of impact absorbing material;

said control means comprise a flexible strap mounted on each external side of the impact absorbing liner, said flexible straps being permanently fixed to the front of the impact absorbing liner by means of hardware;

wherein each block of the plurality of blocks has mounted on an external face of the respective block a coupling pin comprising a central body ending with a widened extension.

17. The helmet of claim 16, wherein the plurality of blocks comprises an expanded polystyrene or an expanded polypropylene.

18. A helmet comprising:

an impact absorbing liner, the liner comprising:

an adjustable means for adjusting the interior size and shape of the impact absorbing liner, said adjustable means comprising a plurality of blocks, each block being suitable to be displaceable toward or away from the head of the user independently of other blocks, by means of control means and an actuation mechanism, the blocks being made of impact absorbing material;

said control means comprise a flexible strap mounted on each external side of the impact absorbing liner, said flexible straps being permanently fixed to the front of the impact absorbing liner by means of hardware;

wherein each block is housed into a correspondingly shaped through-cavity provided in the impact absorbing liner; said through-cavity is shaped to prevent any side displacement of the blocks except for the movement towards or away from a head of the user.

* * * * *